US008511753B2

(12) United States Patent
Huang

(10) Patent No.: US 8,511,753 B2
(45) Date of Patent: Aug. 20, 2013

(54) DISMOUNTABLE CHAIR ASSEMBLY

(76) Inventor: Tsung-Chieh Huang, Kaohsiung Hsien (TW)

( * ) Notice: Subject to any disclaimer, the term of this patent is extended or adjusted under 35 U.S.C. 154(b) by 0 days.

(21) Appl. No.: 13/043,449

(22) Filed: Mar. 8, 2011

(65) Prior Publication Data

US 2012/0228917 A1 Sep. 13, 2012

(51) Int. Cl.
*A47C 7/00* (2006.01)

(52) U.S. Cl.
USPC ..... 297/440.22; 297/440.2; 297/446.1; 297/449.1

(58) Field of Classification Search
USPC ..... 297/440.2, 440.21, 440.22, 446.1, 297/446.2, 449.1
See application file for complete search history.

(56) References Cited

U.S. PATENT DOCUMENTS

| | | | | |
|---|---|---|---|---|
| 1,054,125 | A * | 2/1913 | Kohn, J. | 297/446.2 |
| 1,674,220 | A * | 6/1928 | Percival | 297/440.22 |
| 3,236,558 | A * | 2/1966 | Kaufman | 297/59 |
| 3,672,723 | A * | 6/1972 | Decursu et al. | 297/440.24 |
| 6,017,092 | A * | 1/2000 | Lee | 297/440.15 |
| 7,510,244 | B1 * | 3/2009 | Shin | 297/451.11 |
| 2009/0072599 | A1 * | 3/2009 | Xu | 297/239 |

* cited by examiner

*Primary Examiner* — David Dunn
*Assistant Examiner* — Timothy J Brindley

(57) ABSTRACT

A dismountable chair assembly includes a chair frame, back cushion, and seat cushion. The chair frame includes an H-shaped chair frame, two inverse L-shaped front chair feet, and a front transverse shaft. The back cushion is arranged to two upper shafts of the H-shaped chair frame. The lower sides of the two upper shafts are rear chair feet. A middle shaft serves to link the two inverse L-shaped chair feet and support the seat cushion. A bottom side of the seat cushion has a round skirt. Two columns are formed to a front side of the skirt. Two open holes are formed to a rear side of the skirt for being penetrated by the two inverse L-shaped front chair feet. Two rear sides of two inverse L-shaped front chair feet penetrating through the two open holes can be fixed to the middle shaft of the H-shaped chair frame by bolts.

3 Claims, 7 Drawing Sheets

DISMOUNTABLE CHAIR ASSEMBLY

FIELD OF THE INVENTION

The present invention relates to chair, and particular to a dismountable chair assembly.

DESCRIPTION OF THE PRIOR ART

Prior chair with four feet usually has a welded metal tube frame equipped with back cushion and seat cushion. Such design has various styles depending on different needs and ideas. However, the storage and cost are the primary concerns for business or user.

Therefore, a dismountable chair is taking the place of the conventional welded chair. Dismountable chairs are preferable to the users by its simple structure, lower cost, and easy and fast assembly or disassembly.

Known dismountable chairs usually include a frame consisting of two H-shaped frames linked by two transverse shafts. The H-shaped frame has a front chair foot and a rear chair foot. The two H-shaped frames are linked by the two transverse shafts by bolts so that a seat cushion and a back cushion can be arranged to the chair frame. However, such design has the following defects and inconvenience.

1. The seat cushion is downwards buckled to the chair frame. The seat cushion is easily departed or loosened from the chair frame by frequently disassembly or improper pick up of stacked chairs.
2. The back cushion is fixed to lateral shafts by bolts and sleeves. Such design needs many components to achieve.
3. The chair frame and the back cushion are assembled by bolts, and the seat cushion is separately assembled to the frame. The installation efficiency is not good, and the assembly is also poor.

SUMMARY OF THE PRESENT INVENTION

Accordingly, the primary objects of the present invention are listed in the following.

1. To provide a simple-structured chair with lower cost.
2. To provide a fast and easy assembly to user.
3. To provide a firm and stable chair having integral seat cushion and frame.
4. To provide a chair occupying minimum space for package and warehousing.

To achieve above objects, the present invention includes an H-shaped chair frame, back cushion, and a seat cushion. A complete chair frame is formed by the H-shaped chair frame, two inverse L-shaped front chair feet, and a front transverse shaft.

The H-shaped chair frame has two upper shafts and two rear feet transversely linked by a middle shaft. The back cushion is arranged between the two upper shafts. The middle shaft also serves to support the seat cushion.

The seat cushion has a rounded skirt on a bottom side thereof. Two columns are formed to a front side of the skirt for arranging the front transverse shaft. Two open holes are formed to a rear side of the skirt for being penetrated by the two inverse L-shaped front chair feet. Two rear sides of the two inverse L-shaped front chair feet can be fixed to the middle shaft of the H-shaped chair frame by bolts.

The front transverse shaft has two receiving holes on a front side thereof for receiving the two columns of the seat cushion. Two ends of the front transverse shaft are fixed to predetermined positions of the two inverse L-shaped front chair feet respectively by bolts so that the receiving holes are aligned with the columns.

BRIEF DESCRIPTION OF THE DRAWINGS

FIG. 3-1 shows the parts about the assembly of the present invention.

FIG. 3-2 is a partial view about the assembly of the present invention.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
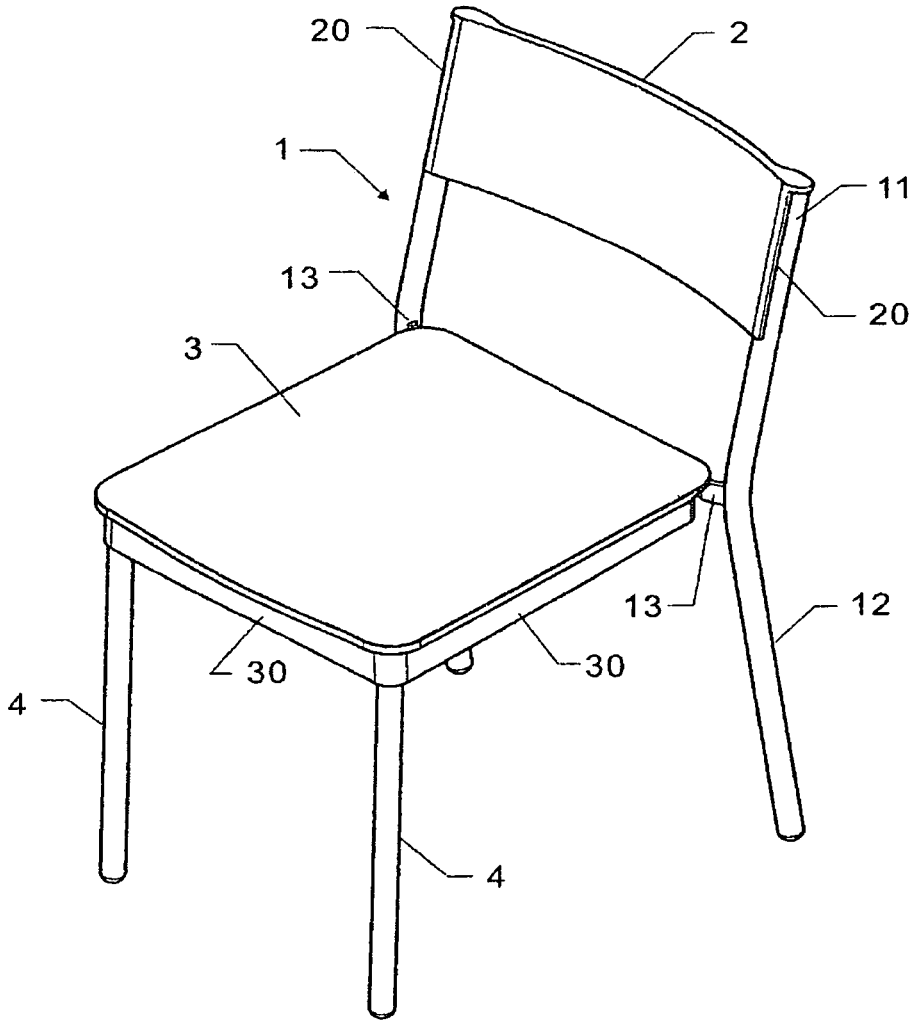
FIG. 1 is a schematic view of the present invention.
Figure 2:
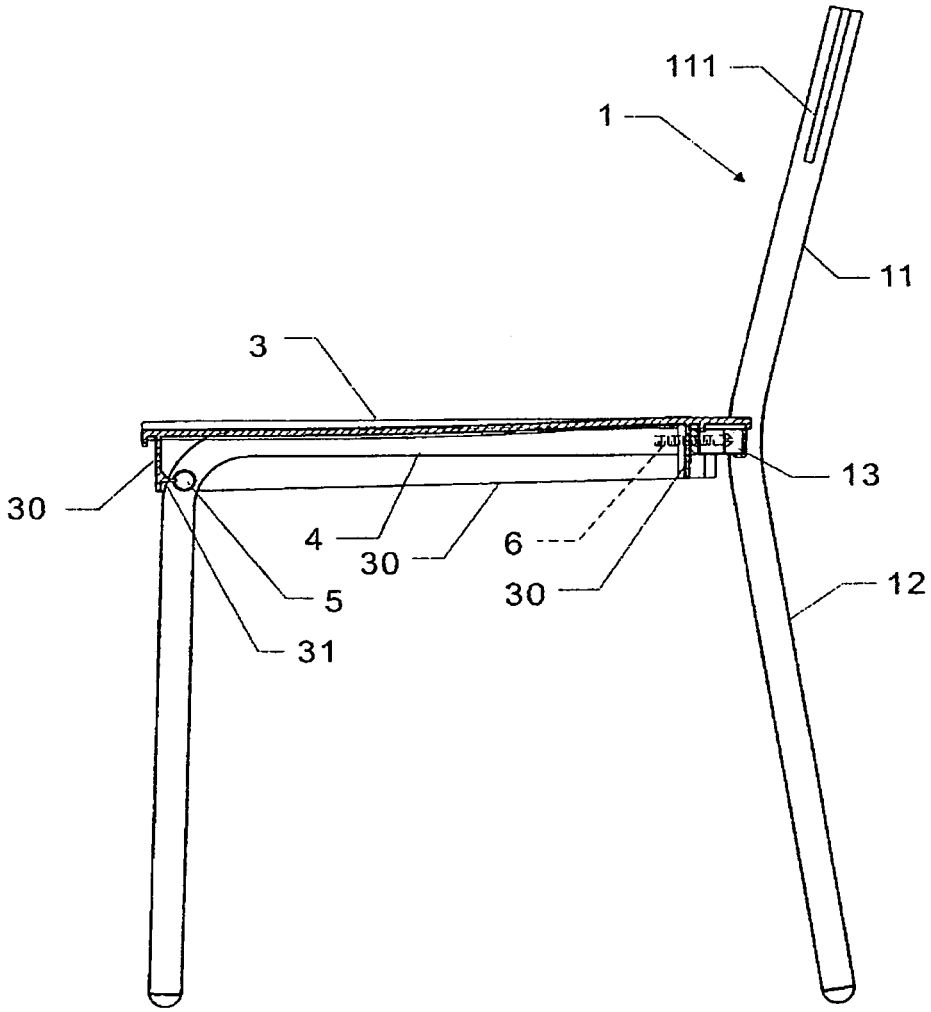
FIG. 2 is a cross-section view showing an installation of a seat cushion and a chair frame.
Figures 1, 3:
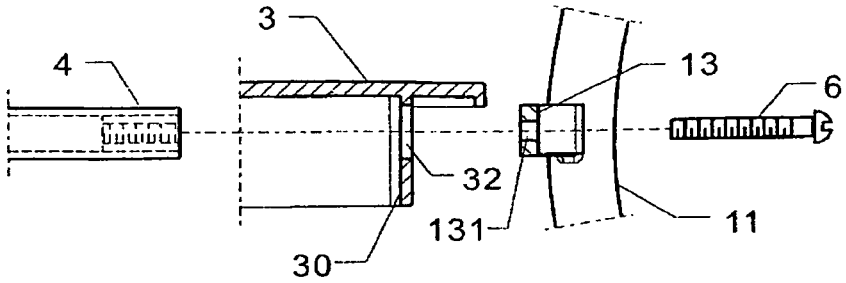
FIG. 3 is an exploded view of the present invention.
Figures 2, 3:
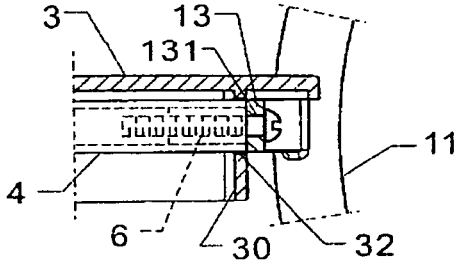
Figure 3:
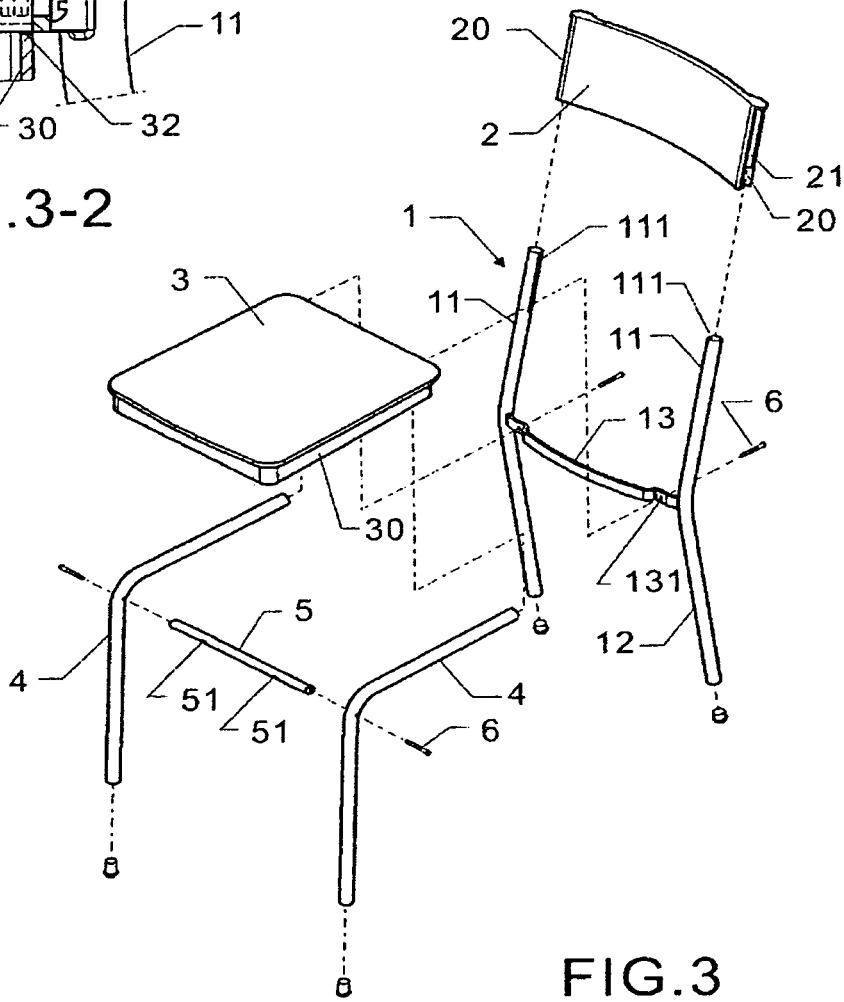
Figure 5:
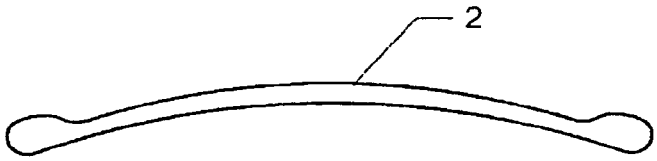
FIG. 5 is a top view showing the back cushion of the present invention.
Figure 4:
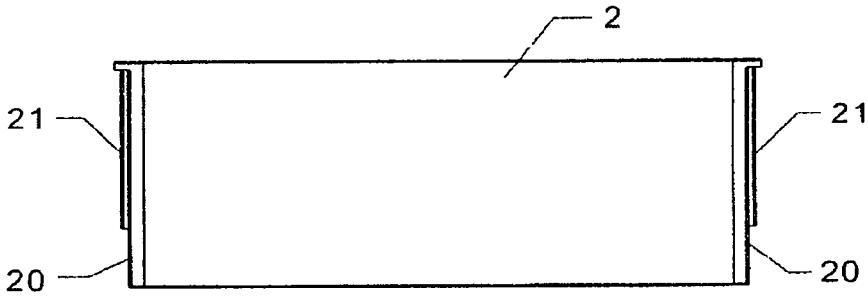
FIG. 4 is a front view showing a back cushion of the present invention.
Figure 6:
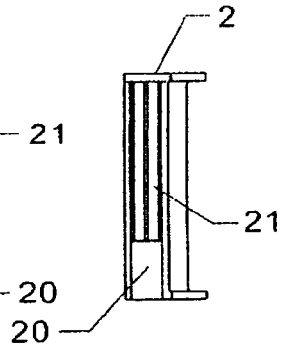
FIG. 6 is a side view showing the back cushion of the present invention.
Figure 7:
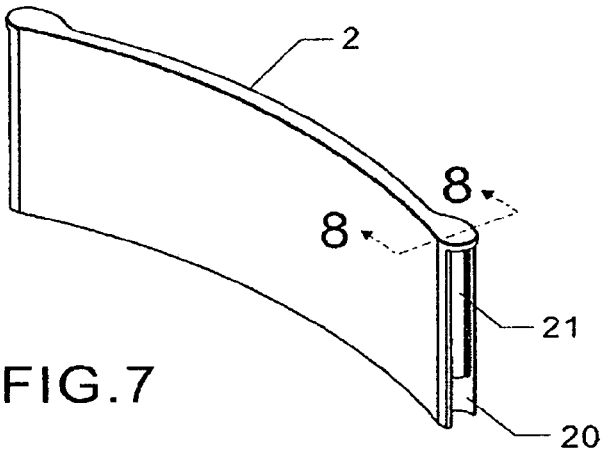
FIG. 7 is a schematic view showing the back cushion of the present invention.
Figure 8:
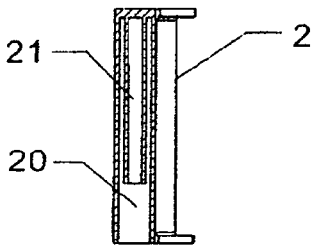
FIG. 8 is a cross-section view along an 8-8 line of FIG. 7.
Figure 11:
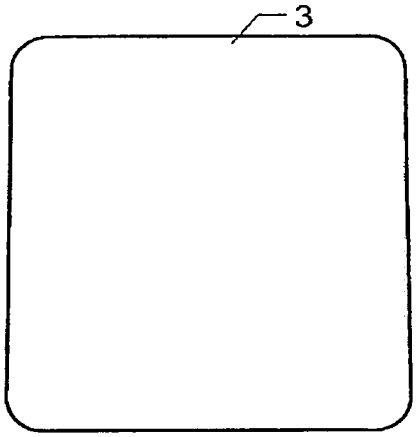
FIG. 11 is a top view showing the seat cushion of the present invention.
Figure 10:
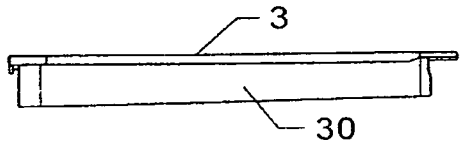
FIG. 10 is a side view showing the seat cushion of the present invention.
Figure 9:
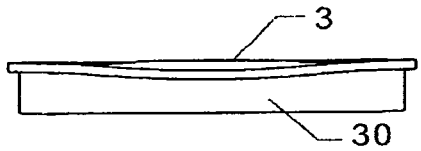
FIG. 9 is a front view showing a seat cushion of the present invention.
Figure 12:
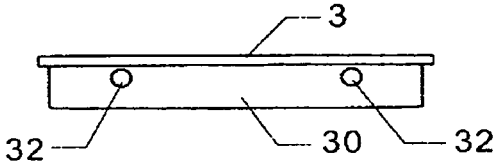
FIG. 12 is a rear view showing the seat cushion of the present invention.
Figure 13:
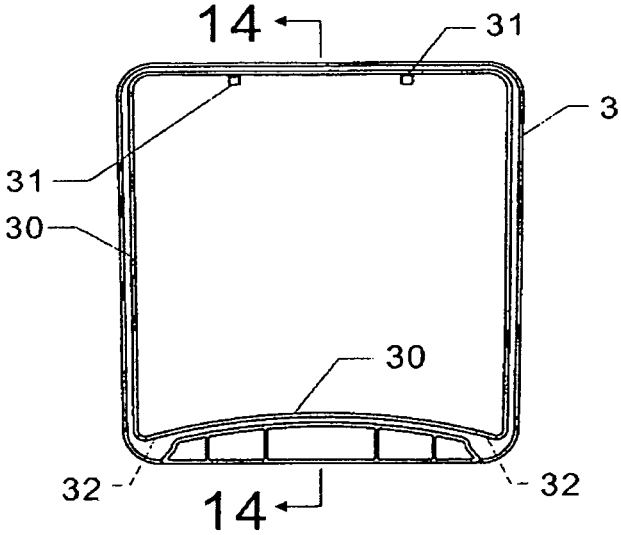
FIG. 13 is an upward view showing the seat cushion of the present invention.
Figure 14:
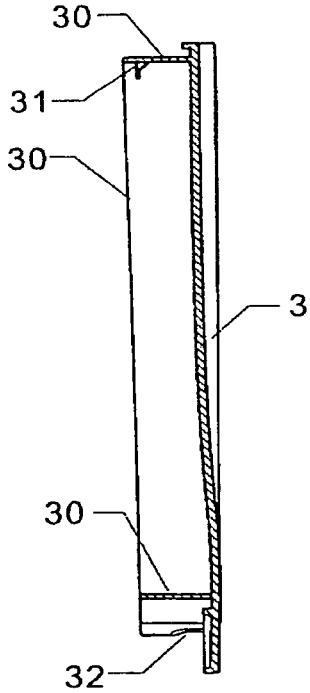
FIG. 14 is a cross-section view along a 14-14 line of the FIG. 13.
Figure 15:
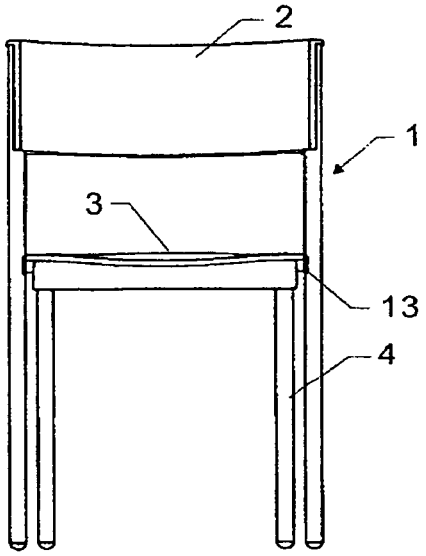
FIG. 15 is a front view of the present invention.
Figure 16:
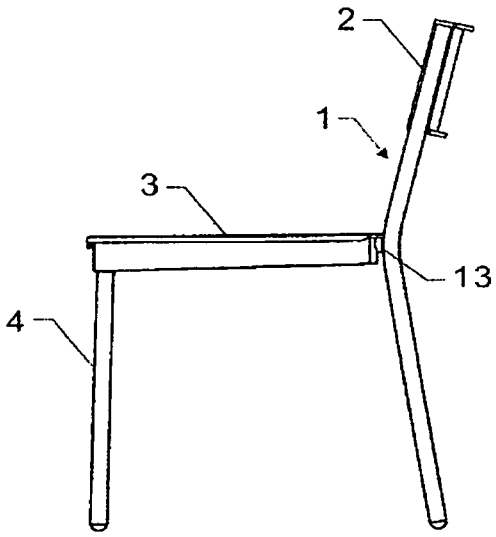
FIG. 16 is a side view of the present invention.
Figure 17:
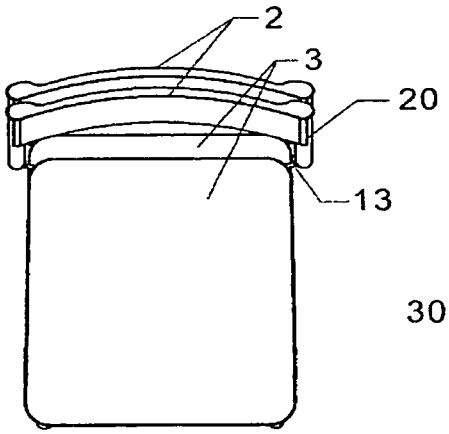
FIG. 17 is a top view showing stacked chairs of the present invention.
Figure 18:
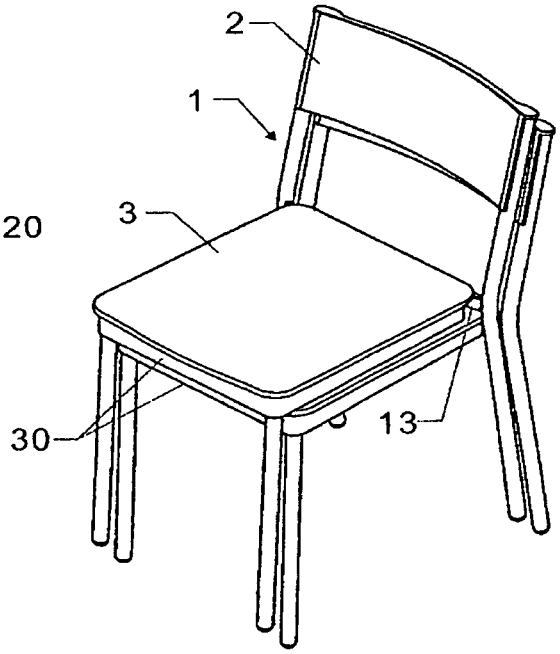
FIG. 18 is a schematic view showing stacked chairs of the present invention.
Figure 19:
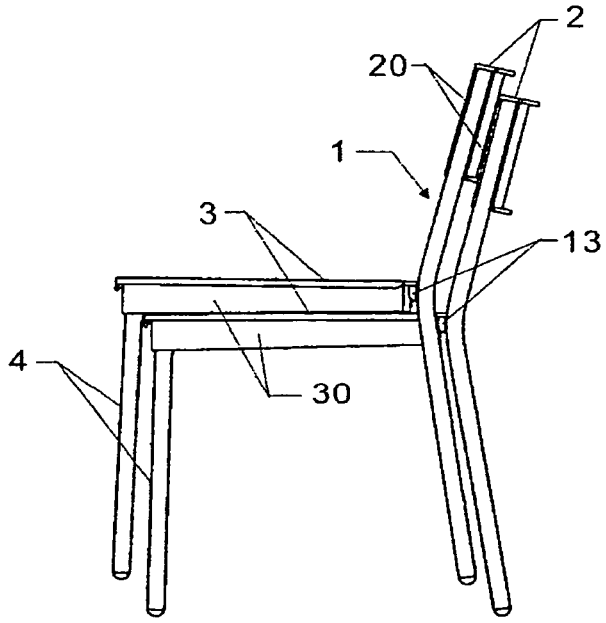
FIG. 19 is a side view showing stacked chairs of the present invention.
Figure 20:
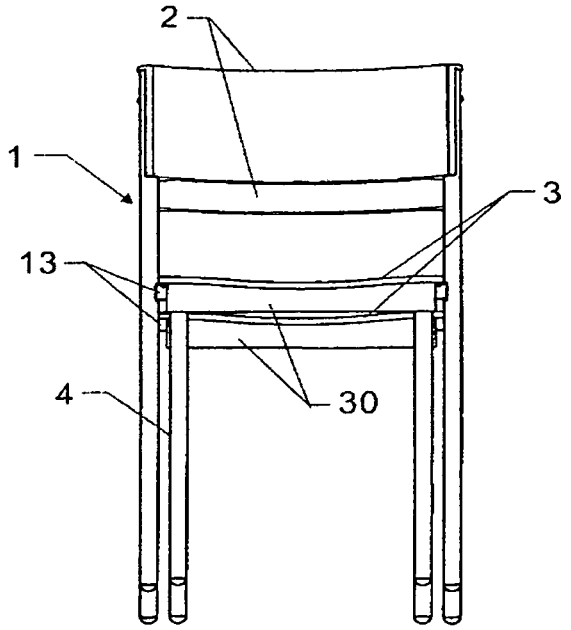
FIG. 20 is a front view showing stacked chairs of the present invention.

Referring to FIGS. 1 to 3, a preferable embodiment of a dismountable chair assembly according to the present invention is illustrated. The dismountable chair assembly includes an H-shaped chair frame 1, back cushion 2, and seat cushion 3. A complete chair frame is formed by the H-shaped chair frame 1, two inverse L-shaped front chair feet 4, and a front transverse shaft 5.

Each of two upper shafts 11 of the H-shaped chair frame 1 has an open slot 111 opened from a top thereof, and the two slots 111 of the two upper shafts are faced to each other. Two slots 111 serve to be inserted by two pins 21 formed to two lateral sides of the back cushion 2 as shown in FIGS. 2 and 3. Two lower sides of the H-shape chair frame 1 are two rear chair feet 12. A middle shaft 13 linked the two shafts of the H-shaped chair frame 1 has two through holes 131. The two inverse L-shaped front chair feet 4 are screwed to the H-shaped chair frame 1 through the through holes 131 by bolts 6(referring to FIGS. 3-1 and 3-2). The middle shaft 13 also serves to support a rear edge of the seat cushion 3.

Referring to FIGS. 4 to 8, the back cushion 2 has two C-shaped receiving slots 20 on two lateral sides thereof. The pin 21 is formed inside the C-shaped receiving slot 20. White the back cushion 2 is installed to the H-shaped chair frame 1, the two pins 21 are inserted into the two open slots 111 of the upper shafts 11 and the round upper shafts 11 are clamped by the C-shaped receiving slots 20 so that the back cushion 2 can be firmly installed to the H-shaped chair frame 1.

Referring to FIGS. 9 to 14, a bottom side of the seat cushion 3 has a rounded skirt 30. Two columns 31 are formed to a front side of the skirt 30 for arranging the front transverse shaft 5. Two open holes 32 are formed to a rear side of the skirt 30 for being penetrated by the two inverse L-shaped front chair feet 4. Two rear sides of the two inverse L-shaped front chair feet 4 penetrating the open holes 32 can be fixed to the middle shaft 13 of the H-shaped chair frame 1 by bolts 6. A rear bottom of the seat cushion 3 is thus lying across the middle shaft 13.

The front transverse shaft 5 has two receiving holes 51 on a front side thereof for receiving the two columns 31 of the seat cushion 3. Two ends of the front transverse shaft 5 are fixed to predetermined front sides of the two inverse L-shaped front chair feet 4 respectively by bolts 6 so that the receiving holes 51 are aligned with the columns 31.

Installation steps of the embodiment of the present invention are listed in the following.

1. The front transverse shaft 5 is fixed between the two inverse L-shaped front chair feet 4 by two bolts 6.

2. The assembling of the step 1 is approached to the bottom side of the seat cushion 3 so that the two rear sides of the two inverse L-shaped front chair feet 4 are penetrating the open holes 32 of the seat cushion 3 and fixed to the middle shaft 13 of the H-shaped chair frame 1 by two bolts 6. The two columns 31 are received into the two receiving holes 51 of the front transverse shaft 5.

3. The chair is completed by the back cushion 2 arranging to the two upper shafts 11 of the H-shaped chair frame 1.

Therefore, the present invention has the following advantages.

1. The assembly is simple with lower cost.

2. Fast installation is friendly and practicable to manufacturing and consumers.

3. The seat cushion and frame can be firmly assembled with high stability and reliability.

4. The package is small as well as the storage space needed before assembly.

5. A disassembly is also easy and fast for the user.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A dismountable chair assembly comprising:

a H-shaped chair frame having two upper shafts and two rear feet transversely linked by a middle shaft; a back cushion being arranged between the two upper shafts;

two inverse L-shaped front chair feet linked by a front transverse shaft; the front transverse shaft having two receiving holes;

a seat cushion having a rounded skirt on a bottom side thereof; two columns being formed to a front portion of the skirt, and two open holes being formed to a rear portion of the seat cushion;

wherein two rear ends of the two inverse L-shaped front chair feet are penetrating the two open holes of the seat cushion respectively and fixed to the middle shaft of the H-shaped chair frame by bolts with the columns of the seat cushion are received into the receiving holes of the front transverse shaft and a rear side of the seat cushion lies across the middle shaft.

2. The dismountable chair assembly as claimed in claim 1, wherein each of two upper shafts of the H-shaped chair frame has an open slot opened from a top thereof, and the two slots of the two upper shafts face to each other; the two slots serve to be inserted by two pins formed to two lateral sides of the back cushion; two lower sides of the two upper shafts are two rear chair feet; the middle shaft has two through holes for arranging the two inverse L-shaped front chair feet by bolts.

3. The dismountable chair assembly as claimed in claim 1, wherein the back cushion has two receiving slots on two lateral sides thereof for holding the two upper shafts of the H-shaped chair frame; two pins are formed inside the two receiving slots of the back cushion respectively for being inserted into the two open slots of the two upper shafts.

* * * * *